US011244637B2

(12) United States Patent
Yan et al.

(10) Patent No.: US 11,244,637 B2
(45) Date of Patent: Feb. 8, 2022

(54) BACKLIGHT CONTROL METHOD AND APPARATUS FOR BACKLIGHT MODULE, DISPLAY DEVICE

(71) Applicants: BEIJING BOE OPTOELECTRONICS TECHNOLOGY CO., LTD., Beijing (CN); BOE TECHNOLOGY GROUP CO., LTD., Beijing (CN)

(72) Inventors: Mingyang Yan, Beijing (CN); Zhifu Li, Beijing (CN); Jinghua Miao, Beijing (CN); Yukun Sun, Beijing (CN); Wenyu Li, Beijing (CN); Lili Chen, Beijing (CN); Hao Zhang, Beijing (CN); Chenxi Zhao, Beijing (CN)

(73) Assignees: BEIJING BOE OPTOELECTRONICS TECHNOLOGY CO., LTD., Beijing (CN); BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 17/041,652

(22) PCT Filed: Apr. 7, 2020

(86) PCT No.: PCT/CN2020/083461
§ 371 (c)(1),
(2) Date: Sep. 25, 2020

(87) PCT Pub. No.: WO2020/224366
PCT Pub. Date: Nov. 12, 2020

(65) Prior Publication Data

US 2021/0166638 A1 Jun. 3, 2021

(30) Foreign Application Priority Data

May 6, 2019 (CN) ..... 201910371545.6

(51) Int. Cl.
*G09G 3/34* (2006.01)

(52) U.S. Cl.
CPC ... *G09G 3/3426* (2013.01); *G09G 2320/0247* (2013.01); *G09G 2320/066* (2013.01);
(Continued)

(58) Field of Classification Search
CPC ..... G09G 3/3406–3426; G09G 2320/0247; G09G 2320/0646; G09G 2320/103; G09G 2360/18
See application file for complete search history.

(56) References Cited

U.S. PATENT DOCUMENTS 8,421,361 B2 * 4/2013 Chen ..... G09G 3/3406 315/151
2011/0134091 A1 6/2011 Chen et al.
(Continued)

FOREIGN PATENT DOCUMENTS

CN 101667406 A 3/2010
CN 102439653 A 5/2012
(Continued)

OTHER PUBLICATIONS

International Search Report dated Jun. 30, 2020, for PCT/CN2020/083461.
(Continued)

*Primary Examiner* — Gene W Lee
(74) *Attorney, Agent, or Firm* — Dinsmore & Shohl LLP

(57) ABSTRACT

The present disclosure relates to a backlight control method and apparatus for a backlight module, a display device and a computer readable storage medium. The backlight module includes a plurality of backlight partitions. The backlight control method includes, for each backlight partition: determining a first brightness change threshold according to an output backlight brightness corresponding to a previous
(Continued)

frame image; and determining, according to a difference between an initial backlight brightness of a current frame image and the output backlight brightness corresponding to the previous frame image and the first brightness change threshold, the output backlight brightness corresponding to the current frame image.

17 Claims, 5 Drawing Sheets

(52) U.S. Cl.
CPC ..... *G09G 2320/0646* (2013.01); *G09G 2320/103* (2013.01); *G09G 2360/18* (2013.01)

(56) References Cited

U.S. PATENT DOCUMENTS

| | | | | |
|---|---|---|---|---|
| 2011/0227818 | A1* | 9/2011 | Su | G09G 3/2003 345/102 |
| 2012/0062622 | A1 | 3/2012 | Koyama et al. | |
| 2013/0093802 | A1* | 4/2013 | Tanaka | G09G 3/003 345/690 |
| 2017/0039994 | A1 | 2/2017 | Wu | |
| 2019/0355316 | A1 | 11/2019 | Ji et al. | |
| 2020/0274081 | A1 | 8/2020 | Fleetham et al. | |

FOREIGN PATENT DOCUMENTS

| | | | |
|---|---|---|---|
| CN | 102682715 | A | 9/2012 |
| CN | 102930831 | A | 2/2013 |
| CN | 103117045 | A | 5/2013 |
| CN | 104240678 | A | 12/2014 |
| CN | 106847192 | A | 6/2017 |
| CN | 107146581 | A | 9/2017 |
| CN | 107845366 | A | 3/2018 |
| CN | 108538260 | A | 9/2018 |
| CN | 108648700 | A | 10/2018 |
| CN | 108810412 | A | 11/2018 |
| CN | 109599068 | A | 4/2019 |

OTHER PUBLICATIONS

The Second Office Action, The State Intellectual Property Office of People's Republic of China, Application No. 201910371545.6, dated Nov. 17, 2021.

* cited by examiner

BACKLIGHT CONTROL METHOD AND APPARATUS FOR BACKLIGHT MODULE, DISPLAY DEVICE

CROSS-REFERENCE TO RELATED APPLICATIONS

This application is a U.S. National Stage Application under U.S.C. § 371 of International Patent Application No. PCT/CN2020/083461, which is based on and claims the priority to the Chinese Patent Application No. 201910371545.6 filed on May 6, 2019, the disclosures of which are hereby incorporated by reference in their entirety.

TECHNICAL FIELD

The present disclosure relates to the technical field of display, and particularly to a backlight control method and apparatus for a backlight module, a display device, and a computer-readable storage medium.

BACKGROUND

With the rapid development of display technologies, people have higher and higher requirements for the display performance. The backlight source, as an important component of the display device, has a significant influence on the display performance.

Local backlight dimming (Local Dimming) utilizes a backlight matrix composed of a plurality of light-emitting diodes (LEDs), instead of a Cold Cathode Fluorescent Lamp (CCFL). The backlight matrix can be adjusted according to the brightness of the displayed image, thereby improving the contrast.

SUMMARY

According to a first aspect of the embodiments of the present disclosure, there is provided a backlight control method for a backlight module comprising a plurality of backlight partitions, wherein for each of the plurality of backlight partitions, the backlight control method comprises: determining a first brightness change threshold according to an output backlight brightness corresponding to a previous frame image; and determining an output backlight brightness corresponding to a current frame image, according to the first brightness change threshold and a difference between an initial backlight brightness of the current frame image and the output backlight brightness corresponding to the previous frame image.

In some embodiments, the first brightness change threshold is determined according to the output backlight brightness corresponding to the previous frame image, a first step size associated with a backlight-controlled display device, and a Weber constant.

In some embodiments, the first brightness change threshold is represented as $$L_{step1} = \begin{cases} L_{th1}, & L_n < L_{th1} \\ L_{th1} + (L_n - L_{th1}) \times K1, & L_n \geq L_{th1} \end{cases},$$

where $L_n$ denotes the output backlight brightness corresponding to the previous frame image, $L_{th1}$ denotes the first step size, and K1 denotes a first constant related to the Weber constant.

In some embodiments, the output backlight brightness corresponding to the current frame image is represented as $$O(L_{n+1}) = \begin{cases} L_n + L_{step1}, & L_{n+1} - L_n \geq L_{step1} \\ L_{n+1}, & L_{n+1} - L_n < L_{step1} \end{cases}$$

where $L_{n+1}$ denotes the initial backlight brightness corresponding to the current frame image.

In some embodiments, the current frame image comprises a plurality of partition images, each having at least one adjacent partition image, and the backlight control method further comprises, for each partition image: determining a second brightness change threshold according to a maximum value of the output backlight brightness of a backlight partition corresponding to the adjacent partition image; and determining the output backlight brightness of the backlight partition corresponding to the partition image according to a difference between the maximum value of the output backlight brightness of the backlight partition corresponding to the adjacent partition image and the initial backlight brightness of the backlight partition corresponding to the partition image and the second brightness change threshold.

In some embodiments, the second brightness change threshold is determined according to the maximum value of the output backlight brightness of the backlight partition corresponding to the adjacent partition image, a second step size related to the backlight-controlled display device, and a Weber constant.

In some embodiments, the second brightness change threshold is represented as $$L_{step2} = \begin{cases} L_{th2}, & L_{max} < L_{th2} \\ L_{th2} + (L_{max} - L_{th2}) \times K2, & L_{max} \geq L_{th2} \end{cases}$$

where $L_{max}$ denotes the maximum value of the output backlight brightness of the backlight partition corresponding to the adjacent partition image, $L_{th2}$ denotes the second step size, and K2 denotes a second constant related to the Weber constant.

In some embodiments, the output backlight brightness of the backlight partition corresponding to the partition image is expressed as $$O(L) = \begin{cases} L_{max} - L_{step2}, & L_{max} - L \geq L_{step2} \\ L, & L_{max} - L < L_{step2} \end{cases}$$

where L denotes the initial backlight brightness of the backlight partition corresponding to the partition image.

In some embodiments, the step of determining the second brightness change threshold and the step of determining the output backlight brightness of the backlight partition corresponding to the partition are performed a specified number of times.

In some embodiments, the initial backlight brightness corresponding to the current frame image and the output backlight brightness corresponding to the previous frame image are respectively stored in different buffer spaces according to frame parity of the images.

According to a second aspect of the embodiments of the present disclosure, there is provided a backlight control apparatus for a backlight module comprising a plurality of backlight partitions, wherein for each of the plurality of backlight partitions, the backlight control apparatus comprises: a first brightness change threshold determining module configured to determine a first brightness change threshold according to an output backlight brightness corresponding to a previous frame image; and a first output backlight brightness determining module configured to determine an output backlight brightness corresponding to a current frame image, according to the first brightness change threshold and a difference between an initial backlight brightness of the current frame image and the output backlight brightness corresponding to the previous frame image.

In some embodiments, the current frame image comprises a plurality of partition images, each having at least one adjacent partition image, and the backlight control apparatus further comprises, for each partition image: a second brightness change threshold determining module configured to determine a second brightness change threshold according to a maximum value of the output backlight brightness of a backlight partition corresponding to the adjacent partition image; and a second output backlight brightness determining module configured to determine the output backlight brightness of the backlight partition corresponding to the partition image, according to the second brightness change threshold and a difference between the maximum value of the output backlight brightness of the backlight partition corresponding to the at least one adjacent partition image and the initial backlight brightness of the backlight partition corresponding to the partition image.

According to a third aspect of the embodiments of the present disclosure, there is provided a backlight control apparatus for a backlight module, comprising: a memory; and a processor coupled to the memory, the processor configured to perform the backlight control method according to any of the preceding embodiments based on instructions stored in the memory.

According to a fourth aspect of the embodiments of the present disclosure, there is provided a non-transitory computer-readable storage medium having stored thereon a computer program which, when executed by a processor, implements the backlight control method according to any of the preceding embodiments.

According to a fifth aspect of the embodiments of the present disclosure, there is provided a display device comprising the backlight control apparatus of any of the preceding embodiments.

In some embodiments, the display device further comprises: a backlight module configured to output a corresponding backlight brightness based on the control of the backlight control apparatus; and a display panel configured to display the current frame image based on the backlight brightness.

According to a sixth aspect of the embodiments of the present disclosure, there is provided a display method comprising: acquiring an image; acquiring a backlight brightness of each partition corresponding to the image; performing the backlight control method of any of the preceding embodiments to control the backlight module to output the corresponding backlight brightness; and displaying the image based on the backlight brightness.

In some embodiments, the display method further comprises: performing a smoothing process on the backlight brightness output by the backlight module; and performing pixel compensation according to the output backlight brightness of the backlight partition corresponding to each pixel, wherein the image is displayed based on the compensated image data.

Further features of the present disclosure and advantages thereof will become apparent from the following detailed description of exemplary embodiments with reference to the attached drawings.

BRIEF DESCRIPTION OF THE DRAWINGS

The accompanying drawings, which constitute a part of the specification, illustrate the embodiments of the present disclosure and, together with the description, serve to explain the principles of the present disclosure.

The present disclosure will be understood more clearly according to the following detailed description with reference to the accompanying drawings.

Please be appreciated that, the sizes of various portions shown in the accompanying drawings are not drawn to actual scale. Furthermore, identical or similar reference numerals are used to refer to identical or similar members.

DETAILED DESCRIPTION

Figure 1A:
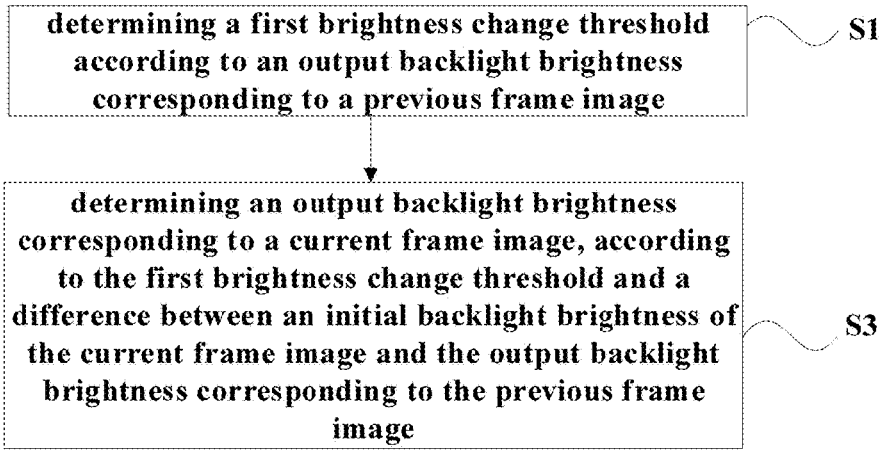
FIG. 1A is a flowchart illustrating a backlight control method according to an embodiment of the present disclosure.

Various exemplary embodiments of the present disclosure will be described in detail with reference to the accompanying drawings in the following. The following description of the exemplary embodiments is merely illustrative in nature and is in no way intended to limit this disclosure, its application, or uses. The present disclosure may be implemented in many different forms and is not limited to the embodiments described herein. These embodiments are provided merely for making the present disclosure thorough and complete, and sufficiently expressing the scope of the present disclosure to one of ordinary skill in the art. It should be noted that the relative arrangement of the components and steps, compositions of materials, the numerical expressions, and numerical values set forth in these embodiments are interpreted to be merely illustrative instead of restrictive, unless it is specifically stated otherwise.

All terms (comprising technical or scientific terms) used in this disclosure have the same meanings as understood by one of ordinary skill in the art, unless otherwise specifically defined. It should also be understood that the terms defined in common dictionaries should be interpreted as having meanings consistent with their meanings in the context of the relevant technologies, but should not be interpreted with idealized or extremely formalized meanings, unless otherwise expressly defined herein.

Techniques, methods and apparatus as known by one of ordinary skill in the relevant art may not be discussed in detail, but are intended to be regarded as a part of the specification where appropriate.

In local backlight dimming, a backlight module comprises a plurality of backlight partitions. The backlight brightness of the backlight partition corresponding to a bright part in the display image can be adjusted to be larger, and the backlight brightness of the backlight partition corresponding to a dark part in the display image can be adjusted to be lower or even be closed, thereby improving the contrast. However, in practical applications, since the pixel resolution is much larger than the backlight resolution, high-brightness pixels and low-brightness pixels in some scenes will correspond to the same backlight partition. In this case, since the liquid crystal cannot be completely closed, light leakage will occur in some regions where light and dark coexist. When these regions where light and dark coexist change rapidly, regions where light leakage occurs also changes rapidly, thereby causing a flicker phenomenon perceived by human eyes. Such a flicker phenomenon is particularly noticeable in a virtual reality (VR) device without ambient stray light interference.

The inventors found according to backlight jump experiments and the Weber's law that, a backlight change range which is not easy to be perceived by human eyes is dynamically decided by a target brightness and an ambient brightness. The Weber's law is used to describe a perceptible threshold of a person for various stimulation amounts, which may be expressed as $K=\Delta I/I$, where $\Delta I$ is an increment of the stimulation amount, I is the current stimulation amount, and K denotes a constant. It is found by applying the weber's law to the observation process of human eyes on the screen brightness that: the brighter the observed object, the higher a threshold for human eyes to perceive a jump. Based on this, the present disclosure employs a dynamic step size (i.e., a brightness change threshold) rather than a fixed step size to limit the backlight change, thereby mitigating or even eliminating the flicker phenomenon.

FIG. 1A is a flowchart illustrating a backlight control method (also referred to as an inter-frame sudden change suppression method) for a backlight module according to an embodiment of the present disclosure.

The backlight module comprises a plurality of backlight partitions, and different backlight partitions correspond to different display partitions in the display panel. Each display partition corresponds to a portion of the image, i.e., to a partition image. That is, each backlight partition corresponds to one partition image. "corresponding" here means that an orthographic projection of the display partition on the display panel overlaps with that of the backlight partition.

The backlight control method may control the backlight brightness of each backlight partition, i.e., the brightness of each backlight source (e.g., one or more LEDs), individually in real time. Thus, the backlight brightness of each backlight partition may be controlled according to the partition image of each display partition so as to display the corresponding partition image.

Here, one frame image may refer to a certain partition image. For example, pixel analysis may be performed on a certain partition image, and the backlight brightness corresponding to the partition may be obtained by means of a maximum value, an average value, an error correction method, and the like.

Of course, one frame image may also refer to a plurality of partition images. Accordingly, the backlight brightness corresponding to one frame image is a matrix of backlight brightness of the corresponding backlight partitions. For example, for m×n backlight partitions, the backlight brightness of the backlight partitions corresponding to one frame image is a m×n backlight matrix.

As shown in FIG. 1A, for each backlight partition, the backlight control method comprises steps S1-S3.

In step S1, a first brightness change threshold $L_{step1}$ is determined according to an output backlight brightness $L_n$ corresponding to a previous frame image.

In some embodiments, the first brightness change threshold $L_{step1}$ is determined based on the output backlight brightness $L_n$ corresponding to the previous frame image, and a first step size associated with a backlight-controlled display device. $L_{th1}$ reflects a minimum step size of a theoretically allowed change in the inter-frame sudden change suppression method. $L_{th1}$ is negatively correlated with severity of the light leakage of the display device, i.e., the more severe the light leakage, the more noticeable the flicker, the smaller $L_{th1}$·$L_{th1}$ is positively correlated with the number of backlight steps of the display device, i.e., the smaller the number of backlight steps, the more noticeable the flicker, the smaller $L_{th1}$. For example, $L_{th1}$ may be 15, with the number of backlight steps as the unit.

In other embodiments, the first brightness change threshold $L_{step1}$ is determined according to the output backlight brightness $L_n$ corresponding to the previous frame image, the first step size $L_{th1}$ and a Weber constant K. For example, the first brightness change threshold may be represented as $$L_{step1} = \begin{cases} L_{th1}, & L_n < L_{th1} \\ L_{th1} + (L_n - L_{th1}) \times K1, & L_n \geq L_{th1} \end{cases}.$$

In case where the output backlight brightness corresponding to the previous frame image is less than the first step size $L_{th1}$, the first brightness change threshold $L_{step1}$ may be determined as $L_{th1}$; whereas in case where the output backlight brightness corresponding to the previous frame image is greater than or equal to the first step size $L_{th1}$, the first brightness change threshold $L_{step1}$ may be determined as $L_{th1}+(L_n-L_{th1})\times K1$ where K1 denotes a first constant related to the Weber constant K.

In step S3, the output backlight brightness $O(L_{n+1})$ corresponding to the current frame image is determined, according to a difference $(L_{n+1}-L_n)$ between an initial backlight brightness $L_{n+1}$ corresponding to a current frame image and the output backlight brightness $L_n$ corresponding to the previous frame image and the first brightness change threshold $L_{step1}$.

In some embodiments, the output backlight brightness corresponding to the current frame image is represented as $$O(L_{n+1}) = \begin{cases} L_n + L_{step1}, & L_{n+1} - L_n \geq L_{step1} \\ L_{n+1}, & L_{n+1} - L_n < L_{step1} \end{cases}.$$

In case where the difference ($L_{n+1}-L_n$) between the initial backlight brightness $L_{n+1}$ corresponding to the current frame image and the output backlight brightness $L_n$ corresponding to the previous frame image is less than the first brightness change threshold $L_{step1}$, the output backlight brightness $O(L_{n+1})$ corresponding to the current frame image may be determined as $L_{n+1}$. that is, the initial backlight brightness corresponding to the current frame image is directly output.

In case where the difference ($L_{n+1}-L_n$) between the initial backlight brightness $L_{n+1}$ corresponding to the current frame image and the output backlight brightness $L_n$ corresponding to the previous frame image is greater than or equal to the first brightness change threshold $L_{step1}$, if the initial backlight brightness corresponding to the current frame image is directly output, a sudden change in brightness that is easy to be perceived by human eyes will occur. Therefore, a single large-amplitude sudden change can be split into continuous small-amplitude changes which are not easy to be perceived by human eyes.

The backlight control method (i.e., the inter-frame sudden change suppression method) in the above embodiments can be packaged as a shader and disposed on a GPU (i.e., image processor) computing platform, so as to improve the real-time performance of the computation. For example, for the m×n backlight partitions, after initial backlight data are input to the shader to be processed, a new backlight matrix may be output.

Figure 1B:
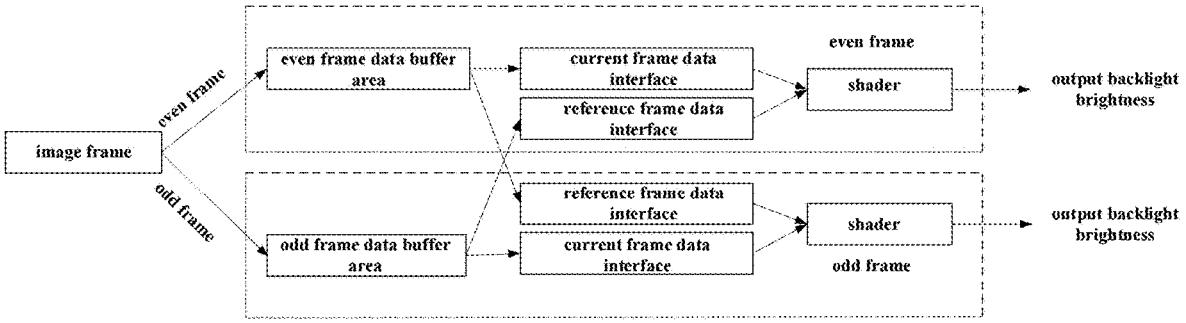
FIG. 1B is a schematic diagram illustrating the backlight control method of FIG. 1A.

FIG. 1B is a schematic diagram illustrating the backlight control method of FIG. 1A.

As shown in FIG. 1B, the backlight data (comprising the initial backlight brightness and the output backlight brightness) corresponding to the image frame may be stored in two different buffer spaces according to frame parity, respectively. This may prevent data errors that may occur during data transmission. For example, when the image frame is an even frame, the backlight data thereof $L_{n+1}$ enters the shader from an even frame data buffer area via a current frame data interface, and the previously buffered previous frame (i.e., odd frame) backlight data $L_n$ enters the shader from an odd frame data buffer area via a reference frame data interface. Similarly, when the image frame is an odd frame, the backlight data thereof $L_{n+1}$ enters the shader from an odd frame data buffer area via the current frame data interface, and the previously buffered previous frame (i.e., even frame) backlight data $L_n$ enters the shader from the even frame data buffer area via the reference frame data interface.

In the above embodiments, the output backlight data corresponding to the previous frame image is used as a reference, and inter-frame sudden change suppression is adopted to limit the backlight change amount between frames within a range that is not easily perceived by human eyes, thereby reducing or even eliminating the flicker phenomenon.

Figure 2A:
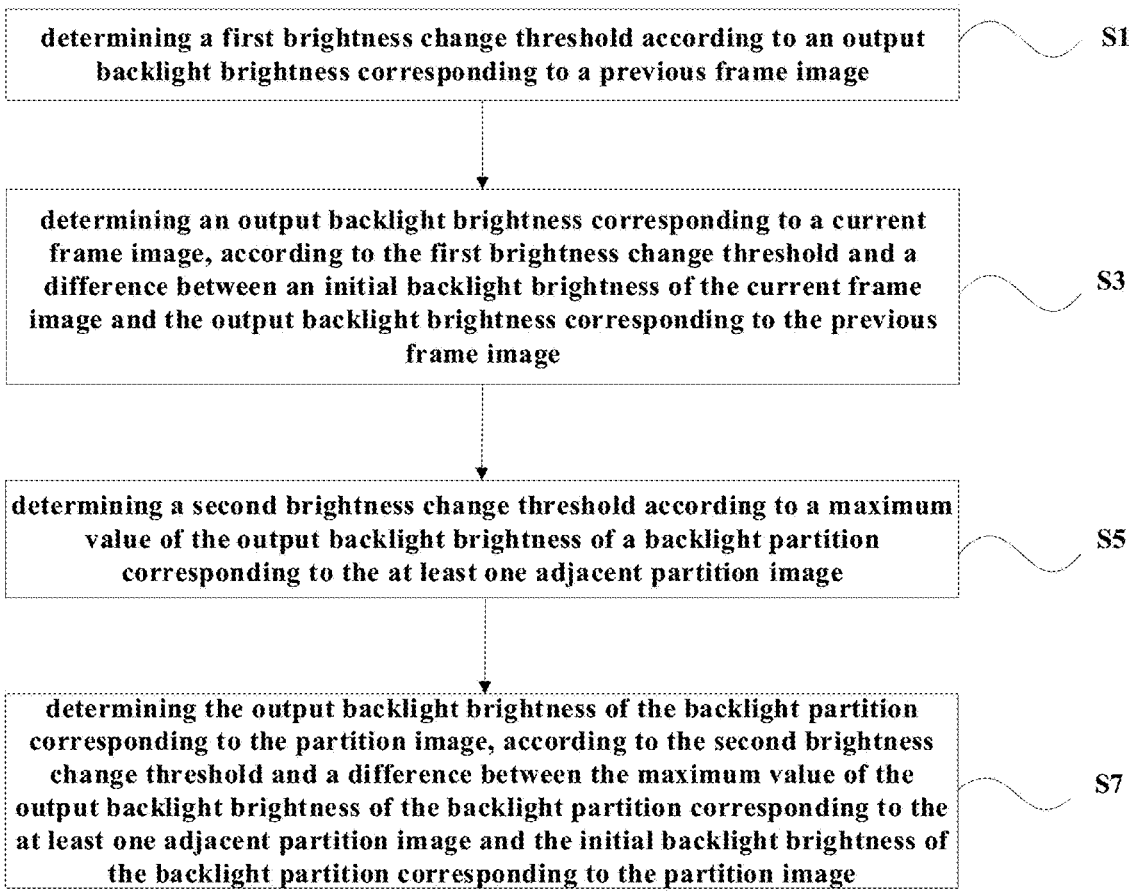
FIG. 2A is a flowchart illustrating a backlight control method according to another embodiment of the present disclosure.

FIG. 2A is a flowchart illustrating a backlight control method (also referred to as an intra-frame smoothing filtering method) according to another embodiment of the present disclosure. FIG. 2A differs from FIG. 1A in that steps S5-S7 are also comprised. Only the differences between FIG. 2A and FIG. 1A will be described below, and the same portions will not be described again.

As previously described, each frame image may comprise a plurality of partition images. Each partition image has at least one adjacent partition image. The backlight brightness corresponding to each of the partition images can be obtained by a similar method as described above. Each partition image to be processed may also be referred to as a current partition image.

In step S5, a second brightness change threshold $L_{step2}$ is determined according to a maximum value $L_{max}$ of the output backlight brightness of the backlight partition corresponding to the adjacent partition image.

In some embodiments, the second brightness change threshold $L_{step2}$ is determined according to the maximum value $L_{max}$ of the output backlight brightness of the backlight partition corresponding to the adjacent partition image, and a second step size $L_{th2}$ associated with the backlight-controlled display device. $L_{th2}$ reflects a minimum step size of a theoretically allowed change in the intra-frame filtering method. Similarly to $L_{th1}$, $L_{th2}$ is also negatively correlated with severity of the light leakage of the display device, i.e., the more severe the light leakage, the more noticeable the flicker, the smaller $L_{th2}$·$L_{th2}$ is positively correlated with the number of backlight steps of the display device, i.e., the smaller the number of backlight steps, the more noticeable the flicker, the smaller $L_{th2}$. For example, $L_{th2}$ may be 30, the unit being the number of backlight steps.

In some other embodiments, the second brightness change threshold $L_{step2}$ is determined according to the maximum value $L_{max}$ of the output backlight brightness of the backlight partition corresponding to the adjacent partition image, the second step size $L_{th2}$ related to the backlight-controlled display device, and the Weber constant K. For example, the second brightness change threshold may be represented as $$L_{step2} = \begin{cases} L_{th2}, & L_{max} < L_{th2} \\ L_{th2} + (L_{max} - L_{th2}) \times K2, & L_{max} \geq L_{th2} \end{cases}.$$

In case where the maximum value $L_{max}$ of the output backlight brightness of the backlight partition corresponding to the adjacent partition image is less than the second step size $L_{th2}$, the second brightness change threshold $L_{step2}$ may be determined as $L_{th2}$; whereas in case where the maximum value $L_{max}$ of the output backlight brightness of the backlight partition corresponding to the adjacent partition image is greater than or equal to the second step size $L_{th2}$, the second brightness change threshold $L_{step2}$ may be determined as $L_{th2}+(L_{max}-L_{th2})\times K2$, where K2 denotes a second constant related to the Weber constant K.

In step S7, the output backlight brightness O(L) of the backlight partition corresponding to the partition image is determined according to a difference ($L_{max}-L$) between the maximum value of the output backlight brightness of the backlight partition corresponding to the adjacent partition image and the initial backlight brightness of the backlight partition corresponding to the current partition image, and the second brightness change threshold $L_{step2}$.

In some embodiments, the output backlight brightness O(L) of the backlight partition corresponding to the current partition image is expressed as $$O(L) = \begin{cases} L_{max} - L_{step2}, & L_{max} - L \geq L_{step2} \\ L, & L_{max} - L < L_{step2} \end{cases}.$$

In case where the difference ($L_{max}-L$) between the maximum value of the output backlight brightness of the backlight partition corresponding to the adjacent partition image and the backlight brightness corresponding to the current partition image is less than the second brightness change threshold $L_{step2}$, the output backlight brightness O(L) of the backlight partition corresponding to the partition image is determined as L. That is, the initial backlight brightness of the backlight partition corresponding to the current partition image is directly output.

In case where the difference ($L_{max}$−L) between the maximum value of the output backlight brightness of the backlight partition corresponding to the adjacent partition image and the initial backlight brightness of the backlight partition corresponding to the current partition image is greater than or equal to the second brightness change threshold $L_{step2}$, if the initial backlight brightness of the backlight partition corresponding to the current partition image is directly output, a sudden change in brightness that is easy to be perceived by human eyes will occur. Therefore, the output backlight brightness O(L) of the backlight partition corresponding to the current partition image may be determined as $L_{max}-L_{step2}$.

In some embodiments, the intra-frame smoothing filtering method is performed multiple times to achieve a smooth transition of the brightness change. For example, the step of determining the second brightness change threshold and the step of determining the output backlight brightness of the backlight partition corresponding to the partition image are performed a specified number of times.

The backlight control method (i.e., the intra-frame smoothing filtering method) in the above embodiments can also be packaged as a shader and disposed on the GPU computing platform, so as to improve the real-time performance of the computation. Similar to the inter-frame sudden change suppression method, for the m×n backlight partitions, after initial backlight data are input to the shader to be processed, a new backlight matrix may also be output.

Figure 2B:
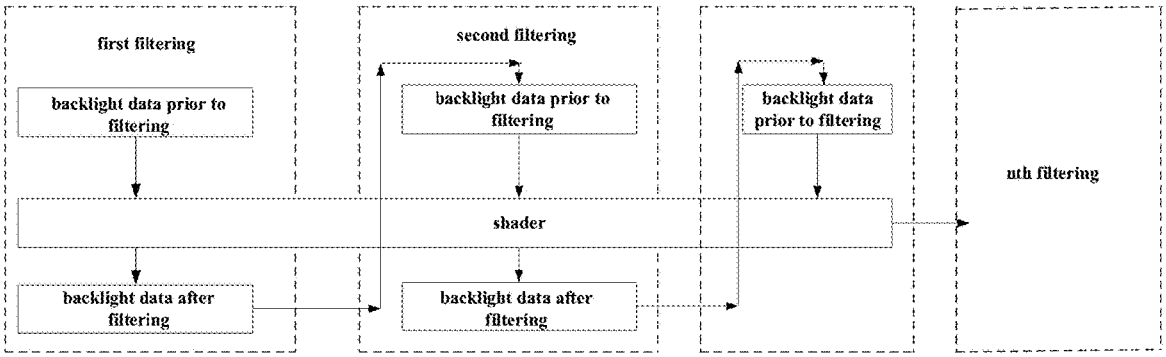
FIG. 2B is a schematic diagram illustrating the backlight control method of FIG. 2A performed multiple times.

FIG. 2B is a schematic diagram illustrating the backlight control method of FIG. 2A performed multiple times.

As shown in FIG. 2B, the output data subjected to the inter-frame sudden change suppression method are used as the input data to the first intra-frame smoothing filtering method, i.e., the backlight data prior to filtering. After the backlight data prior to filtering enters the shader to be processed, backlight data after filtering are obtained. The backlight data after each filtering is taken as the input data to next filtering until a specified number of times (e.g., N times, where N is an integer greater than or equal to 1) of filtering are completed so as to achieve smooth transition of the brightness change.

The effect of filtering multiple times is described below with reference to Tables 1-3, taking a partition having 8 adjacent partitions for example.

Table 1 shows the backlight brightness of the backlight partition corresponding to each partition image before the filtering process. As shown in Table 1, except that the backlight brightness of the backlight partition corresponding to the upper-left partition image is 255, the backlight brightness of the backlight partition corresponding to the other 8 partition images is 0.

TABLE 1

| | | |
|---|---|---|
| 255 | 0 | 0 |
| 0 | 0 | 0 |
| 0 | 0 | 0 |

Table 2 shows the backlight brightness of the backlight partition corresponding to each partition image after the first filtering process. Since the filtering process can be applied to all the partition images, the backlight brightness of the backlight partition corresponding to each partition image after once filtering may change. As shown in Table 2, the backlight brightness corresponding to 3 partition images adjacent to the partition image having the backlight brightness of 255 change to 128, and the backlight brightness change corresponding to the other 5 partition images does not change and is still 0.

TABLE 2

| | | |
|---|---|---|
| 255 | 128 | 0 |
| 128 | 128 | 0 |
| 0 | 0 | 0 |

Table 3 shows the backlight brightness corresponding to each of the partition images after the second filtering process. As shown in Table 3, the backlight brightness corresponding to 5 partition images changes from 0 to 64, and the backlight brightness corresponding to the other 4 partition images does not change and is still 128 or 255.

TABLE 3

| | | |
|---|---|---|
| 255 | 128 | 64 |
| 128 | 128 | 64 |
| 64 | 64 | 64 |

It should be understood that only one example of 3×3 partition is described above. The embodiments of the present disclosure may also be used for other numbers of partitions.

Figure 3:
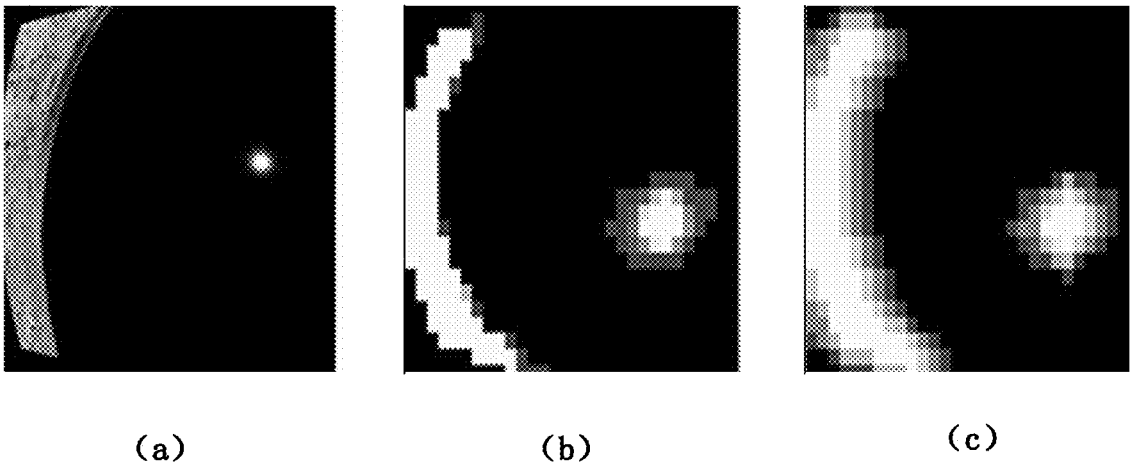
FIG. 3 is a diagram illustrating an effect of a backlight control method according to an embodiment of the present disclosure.

FIG. 3 is a diagram illustrating an effect of a backlight control method (e.g., an intra-frame smoothing filtering method) according to an embodiment of the present disclosure.

In FIG. 3, figure (a) represents a certain frame image; figure (b) represents the backlight brightness of the image not subjected to the intra-frame smoothing filtering method; and figure (c) represents the output backlight brightness of the image subjected to the intra-frame smoothing filtering method.

As can be seen by comparing the figure (b) with the figure (c), after processed by the intra-frame smoothing filtering method, the backlight transition is smoother, i.e. the transition of light-dark boundary is smoother, the sudden change of the backlight brightness is limited within a threshold which is not easy to be perceived by human eyes, and the flicker phenomenon is reduced or even eliminated.

Figure 4A:
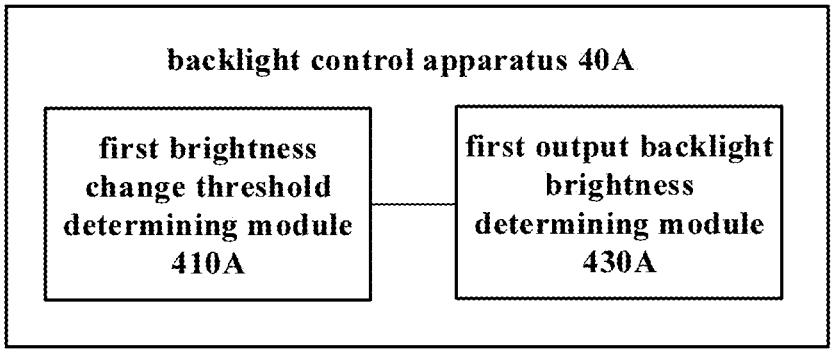
FIG. 4A is a block diagram illustrating a backlight control apparatus according to an embodiment of the present disclosure.

FIG. 4A is a block diagram illustrating a backlight control apparatus according to an embodiment of the present disclosure.

As shown in FIG. 4A, for each backlight partition, the backlight control apparatus 40A comprises: a first brightness change threshold determining module 410A and a first output backlight brightness determining module 430A.

The first brightness change threshold determining module 410A is configured to determine a first brightness change threshold according to an output backlight brightness corresponding to a previous frame image, for example, may perform the step S1 shown in FIG. 1A or FIG. 2A.

The first output backlight brightness determining module 430A is configured to determine the output backlight brightness corresponding to a current frame image according to a difference between the output backlight brightness corresponding to the current frame image and the previous frame image and the first brightness change threshold, for example, may perform the step S3 shown in FIG. 1A or FIG. 2A.

Figure 4B:
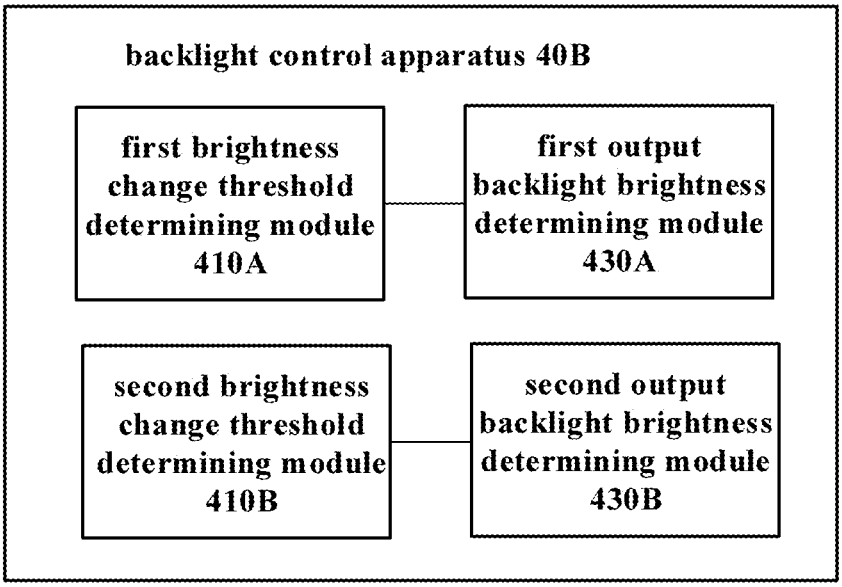
FIG. 4B is a block diagram illustrating a backlight control apparatus according to another embodiment of the present disclosure.

FIG. 4B is a block diagram illustrating a backlight control apparatus according to another embodiment of the present disclosure. FIG. 4B differs from FIG. 4A in that, a second brightness change threshold determining module 410B and a second output backlight brightness determining module 430B are further comprised. Only the differences between FIG. 4B and FIG. 4A will be described below, and the same portions will not be described again.

The second brightness change threshold determining module 410B is configured to determine a second brightness change threshold according to a maximum value of the output backlight brightness of the backlight partition corresponding to an adjacent partition image, for example, may perform the step S5 shown in FIG. 2A.

The second output backlight brightness determining module 430B is configured to determine the output backlight brightness of the backlight partition corresponding to the current partition image according to a difference between the maximum value of the output backlight brightness of the backlight partition corresponding to the adjacent partition image and the backlight brightness corresponding to the current partition image, and the second brightness change threshold, for example, may perform the step S7 shown in FIG. 2A.

Figure 4C:
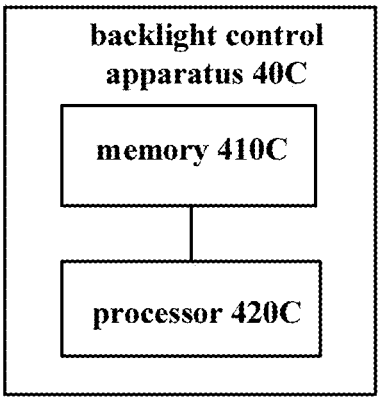
FIG. 4C is a block diagram illustrating a backlight control apparatus according to still another embodiment of the present disclosure.

FIG. 4C is a block diagram illustrating a backlight control apparatus according to still another embodiment of the present disclosure. As shown in FIG. 4C, the backlight control apparatus 40C comprises: a memory 410C and a processor 420C coupled to the memory 410C. The memory 410C is configured to store instructions for performing a corresponding embodiment of the backlight control method. The processor 420C is configured to perform the backlight control method in any of some embodiments of the present disclosure based on the instructions stored in the memory 410C.

It should be understood that the various steps in the foregoing backlight control method may be implemented by a processor, and may be implemented in any one of software, hardware, firmware, or a combination thereof.

In addition to the backlight control method and apparatus, the embodiments of the present disclosure may take the form of a computer program product embodied on one or more non-volatile storage medium containing computer program instructions. Accordingly, the embodiments of the present disclosure also provide a computer-readable storage medium, on which computer instructions are stored, and the instructions, when executed by a processor, implement the backlight control method in any of the preceding embodiments.

The embodiments of the present disclosure further provide a display device comprising the backlight control apparatus according to any of the preceding embodiments.

Figure 5:
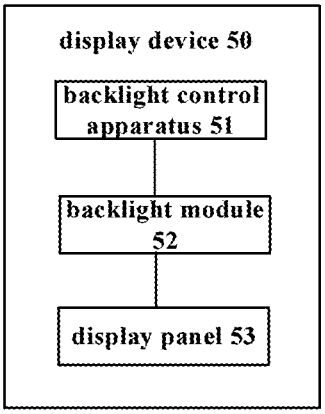
FIG. 5 is a block diagram illustrating a display device according to an embodiment of the present disclosure.

FIG. 5 is a block diagram illustrating a display device according to an embodiment of the present disclosure. As shown in FIG. 5, the display device 50 comprises a backlight control apparatus 51, a backlight module 52 and a display panel 53.

The backlight control apparatus 51 is configured to perform the backlight control method described in any of the preceding embodiments. For example, the backlight control apparatus 51 may perform some of the steps S1 to S7. The backlight control apparatus 51 is, for example, the backlight control apparatus 40A, 40B or 40C in the preceding embodiments.

The backlight module 52 is configured to output a corresponding backlight based on the control of the backlight control apparatus 51. In some embodiments, the backlight module 52 comprises an array of LEDs. The display panel 53 is configured to display an image. The display panel comprises, for example, a liquid crystal display panel.

In some embodiments, the display device may be any product or component with a display function, such as a mobile phone, a tablet computer, a television set, a notebook computer, a digital photo frame, a navigator.

Figure 6:
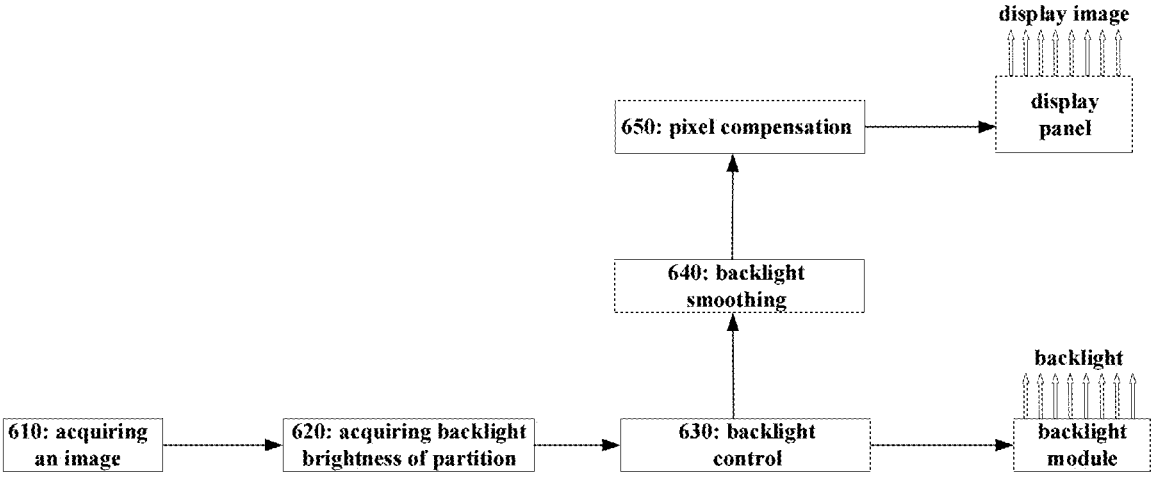
FIG. 6 is a schematic diagram illustrating a display method according to an embodiment of the present disclosure.

FIG. 6 is a schematic diagram illustrating a display method according to an embodiment of the present disclosure.

As shown in FIG. 6, the display method comprises: step 610 of acquiring an image; step 620 of acquiring backlight brightness of each partition corresponding to the image; and step 630 of performing backlight control.

In step 620, the image is subjected to pixel analysis to acquire the backlight brightness of each partition corresponding to the image. As described above, pixel analysis may be performed on a certain partition of the image to acquire the backlight brightness corresponding to the partition by means of a maximum value, an average value, an error correction method and the like.

The backlight control in the step 630 may refer to the backlight control method described in any of the preceding embodiments. The backlight module may output the corresponding backlight brightness based on the backlight control in the step 630.

As shown in FIG. 6, the display method further comprises: step 640 of performing backlight smoothing; and step 650 of performing pixel compensation.

In the step 640, the output backlight brightness of the backlight partition corresponding to each pixel may be simulated according to a brightness diffusion curve of a light source (e.g., LED lamp) in the backlight module, so as to obtain a smoothed backlight matrix.

In the step 650, pixel compensation may be performed according to the output backlight brightness of the backlight partition corresponding to each pixel. In some embodiments, RGB values of the current pixel are fine-tuned, for example, using an S-curve for image contrast compensation and using a logarithmic function for image brightness compensation. The display panel can perform display based on the compensated image data, thereby improving the display quality.

Figure 7:
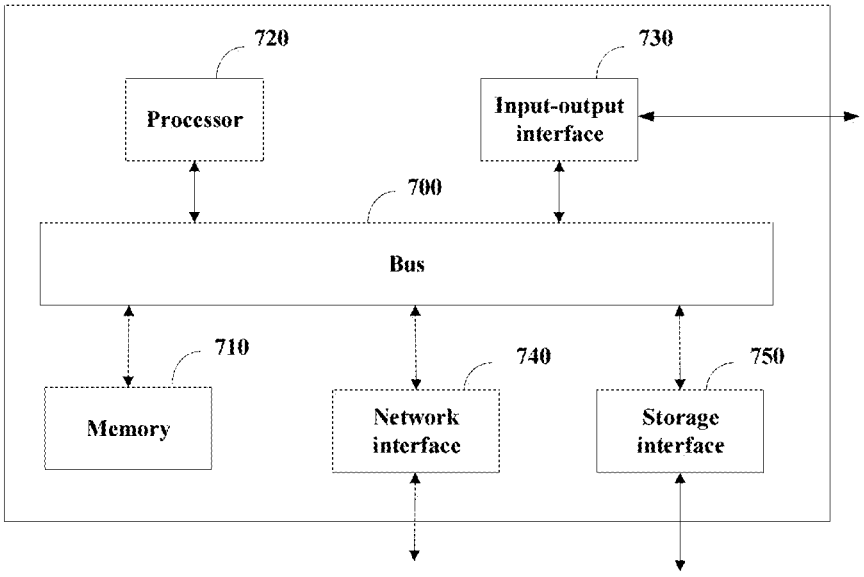
FIG. 7 is a block diagram illustrating a computer system for implementing an embodiment of the present disclosure.

FIG. 7 is a block diagram illustrating a computer system for implementing an embodiment of the present disclosure.

As shown in FIG. 7, the computer system may take the form of a general purpose computing device. The computer system comprises a memory 710, a processor 720 and a bus 700 that connects various system components.

The memory 710 may comprise, for example, a system memory, a non-volatile storage medium, and the like. The system memory stores, for example, an operating system, an application program, a Boot Loader (Boot Loader), and other programs. The system memory may comprise volatile storage medium, such as Random Access Memory (RAM) and/or cache memory. The non-volatile storage medium stores, for example, instructions to perform a corresponding embodiment of the display method. The non-volatile storage medium comprises, but is not limited to, magnetic disk storage, optical storage, flash memory, and the like.

The processor 720 may be implemented with discrete hardware components, such as general purpose processors, Digital Signal Processors (DSPs), Application Specific Integrated Circuits (ASICs), Field Programmable Gate Arrays (FPGAs) or other programmable logic devices, discrete gates or transistors. Accordingly, each of the modules such as the judging module and the determining module may be implemented by a Central Processing Unit (CPU) executing instructions in a memory to perform the corresponding steps, or may be implemented by a dedicated circuit to perform the corresponding steps.

The bus 700 may use any of a variety of bus architectures. For example, the bus architectures comprise, but are not limited to, Industry Standard Architecture (ISA) bus, Micro Channel Architecture (MCA) bus, and Peripheral Component Interconnect (PCI) bus.

The computer system may also comprise an input/output interface 730, a network interface 740, a storage interface 750, and the like. These interfaces 730, 740, 750, as well as the memory 710 and the processor 720, may be connected by the bus 700. The input/output interface 730 may provide a connection interface for input/output devices such as a display, a mouse, and a keyboard. The network interface 740 provides a connection interface for various networking devices. The storage interface 750 provides a connection interface for external storage devices such as a floppy disk, a USB disk, and an SD card.

So far, the embodiments of this disclosure have been described in detail. In order to avoid obscuring the idea of this disclosure, some details well known in the art are omitted. A person skilled in the art can fully understand how to implement the technical solutions disclosed herein according to the above description.

Although some specific embodiments of the present disclosure have been described in detail with examples, it should be understood by a person skilled in the art that the above examples are only intended to be illustrative but not to limit the scope of the present disclosure. The above embodiments can be modified or partial technical features thereof can be equivalently substituted without departing from the scope and spirit of the present disclosure. The scope of the present disclosure is defined by the attached claims.

What is claimed is:

1. A backlight control method for a backlight module comprising a plurality of backlight partitions, wherein for each of the plurality of backlight partitions, the backlight control method comprises:

determining a first brightness change threshold according to an output backlight brightness corresponding to a previous frame image; and determining an output backlight brightness corresponding to a current frame image, according to the first brightness change threshold and a difference between an initial backlight brightness of the current frame image and the output backlight brightness corresponding to the previous frame image.

2. The backlight control method according to claim 1, wherein the first brightness change threshold is determined according to the output backlight brightness corresponding to the previous frame image, a first step size associated with a display device controlled by the backlight, and a Weber constant.

3. The backlight control method according to claim 2, wherein the first brightness change threshold is represented as $$L_{step1} = \begin{cases} L_{th1}, & L_n < L_{th1} \\ L_{th1} + (L_n - L_{th1}) \times K1, & L_n \geq L_{th1} \end{cases},$$

where $L_n$ denotes the output backlight brightness corresponding to the previous frame image, $L_{th1}$ denotes the first step size, and K1 denotes a first constant related to the Weber constant.

4. The backlight control method according to claim 3, wherein the output backlight brightness corresponding to the current frame image is represented as $$O(L_{n+1}) = \begin{cases} L_n + L_{step1}, & L_{n+1} - L_n \geq L_{step1} \\ L_{n+1}, & L_{n+1} - L_n < L_{step1} \end{cases},$$

where $L_{n+1}$ denotes the initial backlight brightness corresponding to the current frame image.

5. The backlight control method according to claim 1, wherein the current frame image comprises a plurality of partition images, each partition image of the plurality of partition images having at least one adjacent partition image, and for each partition image of the plurality of partition images, the backlight control method further comprises:

determining a second brightness change threshold according to a maximum value of the output backlight brightness of a backlight partition corresponding to the at least one adjacent partition image; and determining the output backlight brightness of the backlight partition corresponding to the partition image, according to the second brightness change threshold and a difference between the maximum value of the output backlight brightness of the backlight partition corresponding to the at least one adjacent partition image and the initial backlight brightness of the backlight partition corresponding to the partition image.

6. The backlight control method according to claim 5, wherein the second brightness change threshold is determined according to the maximum value of the output backlight brightness of the backlight partition corresponding to the adjacent partition image, a second step size related to the backlight-controlled display device, and a Weber constant.

7. The backlight control method according to claim 6, wherein the second brightness change threshold is represented as $$L_{step2} = \begin{cases} L_{th2}, & L_{max} < L_{th2} \\ L_{th2} + (L_{max} - L_{th2}) \times K2, & L_{max} \geq L_{th2} \end{cases},$$

where $L_{max}$ denotes the maximum value of the output backlight brightness of the backlight partition corresponding to the at least one adjacent partition image, $L_{th2}$ denotes the second step size, and K2 denotes a second constant related to the Weber constant.

8. The backlight control method according to claim 7, wherein the output backlight brightness of the backlight partition corresponding to the partition image is expressed as $$O(L) = \begin{cases} L_{max} - L_{step2}, & L_{max} - L \geq L_{step2} \\ L, & L_{max} - L < L_{step2} \end{cases},$$

where L denotes the initial backlight brightness of the backlight partition corresponding to the partition image.

9. The backlight control method according to claim 5, wherein the determining of the second brightness change threshold and the determining of the output backlight brightness of the backlight partition corresponding to the partition image are performed for a specified number of times.

10. The backlight control method according to claim 1, wherein the initial backlight brightness corresponding to the current frame image and the output backlight brightness corresponding to the previous frame image are respectively stored in different buffer areas according to frame parity of images.

11. A backlight control apparatus for a backlight module comprising a plurality of backlight partitions, wherein for each of the plurality of backlight partitions, the backlight control apparatus comprises:

a first brightness change threshold determining module configured to determine a first brightness change threshold according to an output backlight brightness corresponding to a previous frame image; and a first output backlight brightness determining module configured to determine an output backlight brightness corresponding to a current frame image, according to the first brightness change threshold and a difference between an initial backlight brightness of the current frame image and the output backlight brightness corresponding to the previous frame image.

12. The backlight control apparatus according to claim 11, wherein the current frame image comprises a plurality of partition images, each partition image of the plurality of partition images having at least one adjacent partition image, and for the each partition image, the backlight control apparatus further comprises:

a second brightness change threshold determining module configured to determine a second brightness change threshold according to a maximum value of the output backlight brightness of a backlight partition corresponding to the at least one adjacent partition image; and a second output backlight brightness determining module configured to determine the output backlight brightness of the backlight partition corresponding to the partition image, according to the second brightness change threshold and a difference between the maximum value of the output backlight brightness of the backlight partition corresponding to the at least one adjacent partition image and the initial backlight brightness of the backlight partition corresponding to the partition image.

13. A display device comprising:

the backlight control apparatus according to claim 11;

a backlight module configured to output a corresponding backlight brightness based on control of the backlight control apparatus; and a display panel configured to display an image based on the backlight brightness.

14. A backlight control apparatus for a backlight module, comprising:

a memory; and a processor coupled to the memory, the processor configured to perform the backlight control method according to claim 1 based on instructions stored in the memory.

15. A non-transitory computer-readable storage medium having stored thereon a computer program which, when executed by a processor, implements the backlight control method according to claim 1.

16. A display method comprising:

acquiring an image;

acquiring a backlight brightness of each partition corresponding to the image;

performing the backlight control method according to claim 1 to control an backlight module to output the corresponding backlight brightness; and displaying the image based on the backlight brightness.

17. The display method according to claim 16, further comprising:

performing a smoothing process on the backlight brightness output by the backlight module; and performing pixel compensation according to the output backlight brightness of the backlight partition corresponding to each pixel, wherein the image is displayed based on the compensated image data.

* * * * *